US008567442B2

(12) United States Patent
Christiani et al.

(10) Patent No.: US 8,567,442 B2
(45) Date of Patent: Oct. 29, 2013

(54) SOFT START DEVICE FOR PNEUMATIC SYSTEMS AND METHOD FOR THE OPERATION OF A SOFT START DEVICE

(75) Inventors: Peter Christiani, Neuffen (DE); Gunter Gebauer, Esslingen (DE); Bodo Neef, Neuhausen (DE); Markus Kleske, Rechberghausen (DE); Udo Walden, Aichwald (DE)

(73) Assignee: Festo AG & Co. KG, Esslingen (DE)

( * ) Notice: Subject to any disclaimer, the term of this patent is extended or adjusted under 35 U.S.C. 154(b) by 546 days.

(21) Appl. No.: 12/866,713

(22) PCT Filed: Feb. 15, 2008

(86) PCT No.: PCT/EP2008/001164

§ 371 (c)(1),
(2), (4) Date: Aug. 6, 2010

(87) PCT Pub. No.: WO2009/100734

PCT Pub. Date: Aug. 20, 2009

(65) Prior Publication Data

US 2011/0277843 A1 Nov. 17, 2011

(51) Int. Cl.
*F15B 13/043* (2006.01)

(52) U.S. Cl.
USPC ..... 137/625.64; 137/613; 137/599.08; 137/628; 137/1

(58) Field of Classification Search
USPC ..... 137/110, 599.01, 599.03, 599.08, 137/601.18, 601.19, 613, 625.64, 628, 629, 137/596.1, 596.15, 596.16, 596.18; 251/26
See application file for complete search history.

(56) References Cited

U.S. PATENT DOCUMENTS 4,694,791 A * 9/1987 Tanaka ..... 91/53
5,038,813 A * 8/1991 Rossow ..... 137/110
5,067,519 A * 11/1991 Russell et al. ..... 137/596.14
5,337,788 A * 8/1994 Nelson ..... 137/629
5,381,828 A * 1/1995 Kimura et al. ..... 137/596

(Continued)

FOREIGN PATENT DOCUMENTS

EP 0758063 B1 9/2002
EP 1645755 A2 4/2006

OTHER PUBLICATIONS

Werner Deppert et al., "Pneumatische Steuerungen, Passage," Pneumatische Steuerungen. Einfuhrung and Grundlagen Pneumatischer Steuerungen, Vogel, Wurzburg, Germany, Jan. 1, 1994, pp. 160-161, XP002433275, Abbildung 4.143.

*Primary Examiner* — Craig Schneider
*Assistant Examiner* — Craig J Price
(74) *Attorney, Agent, or Firm* — Hoffman & Baron, LLP

(57) ABSTRACT

In a soft start device for pneumatic systems comprising a primary inlet where compressed air can be supplied at primary pressure, wherein the primary inlet is, via a valve circuit, connected to at least one secondary outlet which can be coupled to a load and where compressed air can be discharged at secondary pressure, the secondary pressure being lower than or equal to the primary pressure, wherein a main valve is installed between the primary inlet and the secondary outlet, a restrictor device being installed in the bypass, wherein the main valve and the restrictor device together with further directional valves of the valve circuit are interconnected such and the valve circuit can be switched into a standard switching position for venting such that the secondary outlet is vented, the valves of the valve circuit are interconnected such that several further switching positions for venting are possible.

11 Claims, 11 Drawing Sheets

(56) References Cited

U.S. PATENT DOCUMENTS 5,669,422 A * 9/1997 Tarusawa ..... 137/110
7,210,393 B2 * 5/2007 Lucidera ..... 137/110
7,699,073 B2 * 4/2010 Decker et al. ..... 137/613
7,891,375 B2 * 2/2011 Decker ..... 137/596.15
2008/0128036 A1 * 6/2008 Decker ..... 137/629

* cited by examiner

SOFT START DEVICE FOR PNEUMATIC SYSTEMS AND METHOD FOR THE OPERATION OF A SOFT START DEVICE

This application claims priority based on an International Application filed under the Patent Cooperation Treaty, PCT/EP2008/001164, filed Feb. 15, 2008.

BACKGROUND OF THE INVENTION

The invention relates to a soft start device for pneumatic systems and to a method for the operation of a soft start device. The soft start device comprises:

- a primary inlet where compressed air can be supplied at primary pressure,
- wherein the primary inlet is, via a valve circuit, connected to at least one secondary outlet which can be coupled to a load and where compressed air can be discharged at secondary pressure, the secondary pressure being lower than or equal to the primary pressure,
- wherein a main valve of the type 2/2 nc (normally closed) which can be bypassed by means of a bypass is installed between the primary inlet and the secondary outlet, a restrictor device being installed in the bypass,
- wherein the main valve and the restrictor device together with further directional valves of the valve circuit are interconnected such that, in a soft start process while the main valve is initially closed, compressed air is applied to the secondary outlet at a secondary pressure which is lower than primary pressure and increases gradually, until from a defined ratio between secondary and primary pressure the main valve is switched into its open position, so that compressed air arrives at the secondary outlet at primary pressure, and so that
- the valve circuit can be placed in a standard switching position for venting, so that the secondary outlet is vented.

Soft start devices are used in pneumatic systems to supply compressed air to functional units sensitive to pressure surges, such as service units etc., in conditions where the pressure gradually increases from a relatively low secondary pressure to the higher primary or operating pressure. In this way, pressure surges at harmfully high primary pressure are avoided. Functional units sensitive to pressure surges include filter units or double-acting pneumatic cylinders. In the case of double-acting pneumatic cylinders, the piston may be in an intermediate position in the "pressure-less" state of the cylinder, so that the piston, if subjected to the full pressure surge, could suddenly move into one of its end position, which may result in damage to the piston or to the end stop of the cylinder. The unintended piston movement could moreover damage a downstream functional unit, which may once again result in a hazardous situation. Such dangerous movement could result in personal injury in particular. This is prevented by a soft start, causing the piston to move into its end position relatively slowly.

A soft start device is for example disclosed in EP 0 758 063 B1, which describes a starting valve in the form of a seating valve, the valve being vented via a fast venting device. The starting valve comprises a housing wherein a single flow path runs from the inlet to the outlet, the seating valve acting as a restrictor being disposed in the flow path.

In pneumatic systems, certain safety aspects have to be observed. These are for example categorised in the standard EN 954-1 and in the follow-up standard DIN EN ISO 13849-1. To fulfil the requirements of category 3 of EN 954-1, the pneumatic device is subject to so-called "single fault safety" in safety-relevant functions. This means that the system must be capable of venting even if a single fault is present.

A soft start device of the type referred to above which offers "single fault safety" is disclosed in EP 645 755 A2. If one of the valves malfunctions, the secondary outlet can nevertheless be vented. This being so, this soft start device fulfils the requirements of EN 954-1, category 3.

The follow-up standard DIN ISO 13849, however, requires a higher test quality for category 3 and in particular for category 4. It demands in particular that a test or diagnostic mode of the valves should be run prior to the soft start process, in order to eliminate faults in the initiation of the soft start process.

SUMMARY OF THE INVENTION

The invention is therefore based on the problem of creating a soft start device and a method for the operation of a soft start device of the type referred to above, by means of which a diagnostic mode can be executed before the starting process is initiated.

This problem is solved by a soft start device with the features of the independent claim 1. Further developments of the invention are described in the dependent claims.

The soft start device according to the invention is characterised in that

- the inlet of the main valve, which is designed as a fifth directional valve of the type 2/2-nc, is connected to the primary inlet and the outlet is connected to the inlet of a fourth directional valve of the type 3/2-nc and, parallel thereto, to the output-side of the restrictor device, the fifth directional valve being on the control side coupled to the output-side of the restrictor device and in addition to an outlet of a sixth directional valve of the type 4/2-nc,
- the inlet of the first directional valve of the type 3/2-nc is connected to the primary inlet and the outlet is connected to the control side of the sixth directional valve, wherein the first directional valve can be vented via a venting port and actively switched via control-side switching means,
- the inlet of the third directional valve of the type 3/2-nc is connected to the primary inlet and the outlet of the third directional valve is coupled to the control side of a fourth directional valve of the type 3/2-nc, wherein the third directional valve can be vented via a venting port and actively switched via control-side switching means,
- the outlet of the fourth directional valve is connected to the secondary outlet and, parallel thereto, to an inlet of the sixth directional valve, wherein the fourth directional valve can be vented via a venting port, and
- the sixth directional valve can be switched between a normal position and a functional position, wherein in the normal position a first inlet is connected to the secondary outlet and, parallel thereto, to the outlet of the fourth directional valve, while the respective first venting port is open to the atmosphere, and a second inlet is coupled to the control side of the fifth directional valve while a respective second venting port is open to the atmosphere, and wherein, in the functional position, the inlet is connected to the outlet of the fourth directional valve and, parallel thereto, to the secondary outlet, while the respective outlet is coupled to the control side of the fifth directional valve.

The first and third directional valves are therefore connected in parallel, the first directional valve controlling the sixth directional valve and the third directional valve controlling the fourth directional valve. This permits the execution of a test or diagnostic mode wherein the switching states of the fourth and sixth directional valves are checked independently. As the fourth and sixth directional valves are not actively switchable, it is advantageous that the switching states of these valves can be checked before the soft start process is initiated. After long stoppages, in particular, a so-called "slip-stick" effect may develop in these valves, so that these valves may not be switched into their open or functional position even if compressed air is applied to their control side. It is therefore possible to initiate a fault finding process before the start. The diagnostic mode ensures that none of the valves malfunctions in the soft start process.

In a particularly preferred manner, the directional valves which are not actively switchable are held in their nc-position by control springs and in addition by the application of compressed air, in order to make them independent of upstream pressure. As an alternative, these directional valves could be held in their nc-position without the additional application of compressed air, for example by using a control spring with a correspondingly higher spring force.

The restrictor device may comprise an adjustable throttle valve and in addition a fixed restrictor in the form of a restrictor bypass surrounding the adjustable throttle valve. This prevents the total blocking of the flow path if the throttle valve is completely closed.

In a particularly preferred way, a sensor device comprising a plurality of sensors is provided for detecting the current switching states of the valves, in particular of those which are not actively switchable. The sensors may for example be designed as reed switches, but other types of sensors can be used. A control unit coupled to the switching means of the first and third directional valves is expediently provided. This allows for a signal transmission from the sensors to the control unit and, depending on an evaluation result, from the control unit to the switching means.

The invention further includes a method for the operation of a soft start device with the features of the independent claim 11.

The method according to the invention, by means of which a test or diagnostic mode can be executed, comprises the following steps:

- the switching of the first directional valve into its open position, whereby compressed air is applied to the control side of the sixth directional valve,
- the determination of the switching state of the sixth directional valve by means of the respective sensor,
- the detection of the result of the switching state enquiry wherein, if a switching operation of the sixth directional valve has been detected, a switching operation of the third directional valve or the soft start process is initiated,
- the switching of the third directional valve into its open position after or alternatively before the switching of the first directional valve, wherein the first directional valve is in its nc-position while the third directional valve is switched, wherein compressed air is applied to the control side of the fourth directional valve by switching the third directional valve,
- the determination of the switching state of the fourth directional valve by means of the respective sensor,
- the detection of the result of the switching state enquiry wherein, if a switching operation of the fourth directional valve has been detected, a switching operation of the first directional valve or the soft start process is initiated.

As mentioned above, the first and third directional valves are connected in parallel, so that pressure can be applied to the sixth directional valve independently of the fourth directional valve. The first directional valve is expediently switched first, with the result that compressed air is applied to the control side of the sixth directional valve. The switching state of the sixth directional valve is then checked by means of the sensor. If a switching operation has taken place, the strand between primary inlet, first directional valve and sixth directional valve is free of faults, and the process can be followed by a diagnosis of the other strand containing the third and fourth directional valves. The first directional valve is once again in its nc-position. If a switching operation of the fourth directional valve is detected as the third directional valve is switched, this strand too is free of faults. The soft start process can now be initiated. It is of course possible to test the third directional valve first, followed by the strand of the third and fourth directional valves, and then the first directional valve and the strand of the first and sixth directional valves.

In a further development of the invention, signals corresponding to the result of the switching state enquiry are transmitted from the respective sensor to the control unit, the switching means assigned to the first and third directional valves being actuated or not depending on the result. If no fault is detected, the soft start process can be initiated automatically. If however a fault is found in one of the strands, the soft start process is not initiated.

BRIEF DESCRIPTION OF THE DRAWINGS

A preferred embodiment of the invention is illustrated in the drawing and explained in greater detail below. Of the drawing.

DETAILED DESCRIPTION OF THE PREFERRED EMBODIMENTS

FIGS. 1 to 11 show a preferred embodiment of the soft start device 11 according to the invention. The components of the valve circuit can be accommodated together in a valve assembly. A primary inlet P1 is provided to supply compressed air at primary pressure. Via a main flow path 12, the primary inlet P1 is connected to a secondary outlet P2, where compressed air is discharged at secondary pressure to the loads.

Figure 1:
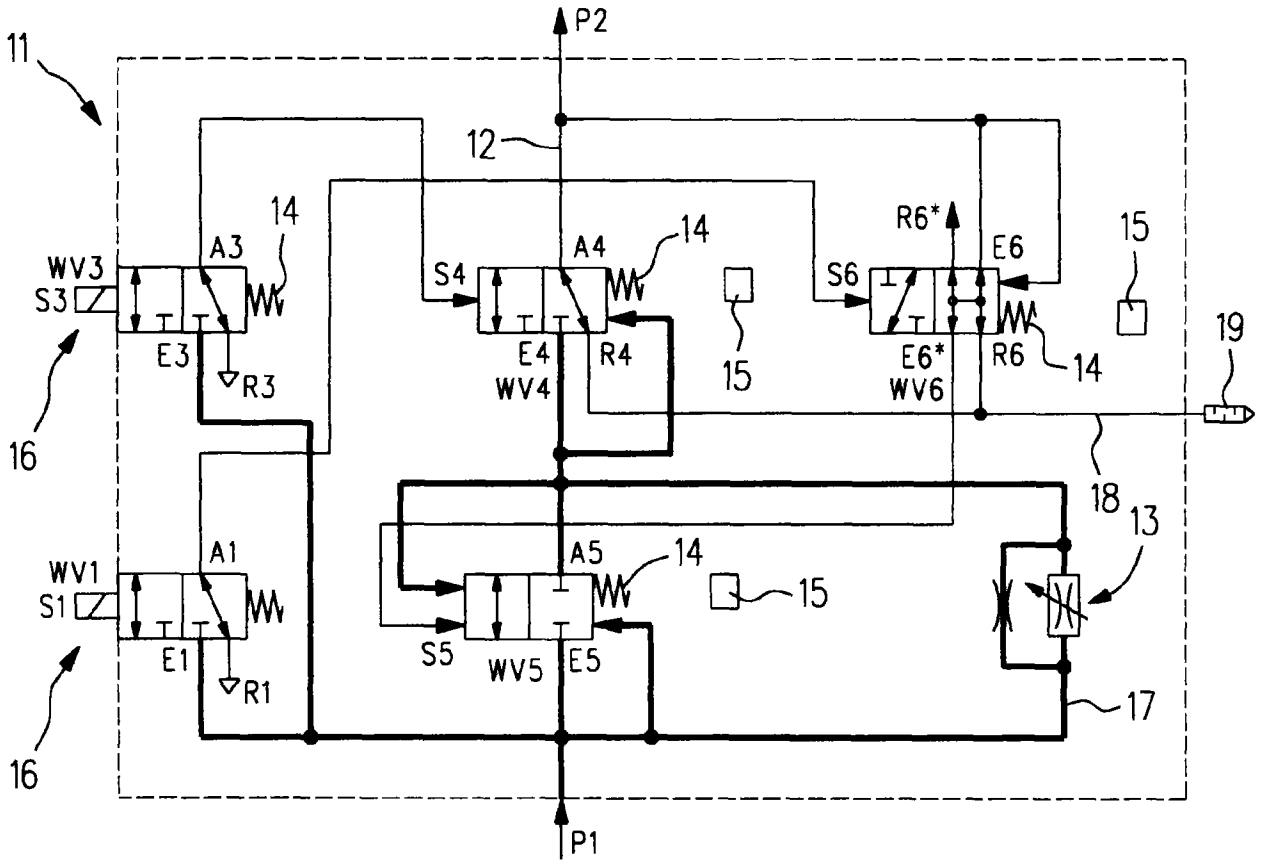
FIG. 1 shows a valve circuit including pneumatically pressurised strands (bold lines) of a preferred embodiment of the soft start device according to the invention in its neutral position prior to the soft start process.

As FIG. 1 shows by way of example, the valve circuit of the preferred embodiment has the following structure:

A fifth directional valve WV5 of the type 2/2-nc is provided, the inlet E5 of which is connected to the primary inlet P1 and the outlet A5 of which is connected to the inlet E4 of a fourth directional valve WV4 of the type 3/2-nc and, parallel thereto, to the output-side of a restrictor device 13, the control side of the fifth directional valve WV5 being coupled to the output side of the restrictor device 13 and in addition to an outlet A6 of a sixth directional valve WV6 of the type 4/2-nc, if the sixth directional valve WV6 is in its functional position as described below. The fifth directional valve WV5 is held in its nc-position by a control spring 14 and in addition by the application of compressed air via a coupling with the primary inlet P1. A sensor for detecting its current switching position is further assigned to the fifth directional valve WV5.

Connected in parallel with the fifth directional valve WV5, a first directional valve WV1 is provided, its inlet E1 being connected to the primary inlet P1 and its outlet A1 being connected to the control side S6 of a sixth directional valve WV6, wherein the first directional valve WV1 can be vented via a venting port R1 and actively switched via switching means 16 provided on the control side. The first directional valve WV1 is further held in its nc-position by a control spring 14.

Connected in parallel to the first directional valve WV1, a third directional valve WV3 is provided, its inlet E3 being coupled to the primary inlet P1 and its outlet A3 being coupled to the control side S4 of a fourth directional valve WV4 of the type 3/2-nc, wherein the third directional valve WV3 can be vented via a venting port R3 and actively switched via switching means 16 provided on the control side.

The fourth directional valve WV4 selected by means of the third directional valve WV3 has its outlet A4 connected to the secondary outlet P2 and, parallel thereto, to an inlet E6 of a sixth directional valve WV6, the fourth directional valve WV4 being ventable via a venting port R4. The fourth directional valve WV4 is held in its nc-position by a control spring 14 and additionally by coupling to the output side of the restrictor device 13 and, parallel thereto, by coupling to the outlet A5 of the fifth directional valve WV5. In addition, a sensor 15 is provided to detect the current switching state of the fourth directional valve WV4.

Finally, the sixth directional valve WV6 selected via the first directional valve WV1 is switchable between a normal position and a functional position; in the normal position, a first inlet E6 is connected to the secondary outlet P2 and, parallel thereto, to the outlet A4 of the fourth directional valve WV4, while the first venting port R6 is open to the atmosphere. In the normal position of the sixth directional valve WV6, a second inlet E6* is further coupled to the control side S5 of the fifth directional valve WV5, while a corresponding second venting port R6* is open to the atmosphere. In the functional position of the sixth directional valve WV6, on the other hand, its inlet E6 is connected to the outlet A4 of the fourth directional valve WV4 and, parallel thereto, to the secondary outlet P2, while the corresponding outlet A6 is coupled to the control side S5 of the fifth directional valve WV5.

FIG. 1 shows a switching position in which all 3/2- or 2/2-type directional valves are in their nc-position and the sixth directional valve WV6 of the type 4/2-nc is in its normal position. This position could also be referred to as neutral position before the soft start process. In this state, compressed air from the primary inlet P1 is applied at primary pressure to the inlet E1 of the closed first directional valve WV1 and, parallel thereto, to the inlet E5 of the closed fifth directional valve WV5 and, parallel thereto, to the inlet E3 of the third directional valve WV3. Parallel thereto, compressed air is applied to the counter-control side of the fifth directional valve WV5 to support the control spring 14. Compressed air finally flows into the bypass 17, reaching the restrictor device 13 and flowing from there to the inlet E4 of the fourth directional valve WV4, the outlet A5 of the closed fifth directional valve WV5 and the control side of S5 of the fifth directional valve WV5. The restrictor device 13 provided is an adjustable throttle valve and in addition a fixed restrictor in the form of a restrictor bypass surrounding the adjustable throttle valve. This prevents the complete blocking of the flow path if the throttle valve is closed. On the contrary, an amount of compressed air can always reach the respective ports of the fourth and fifth directional valves WV4 and WV5 via the restrictor bypass, which has a relatively small cross-section. Finally, compressed air is applied at primary pressure to the counter-control side of the fourth directional valve WV4, thereby supporting to force of the control spring 14.

Figure 2:
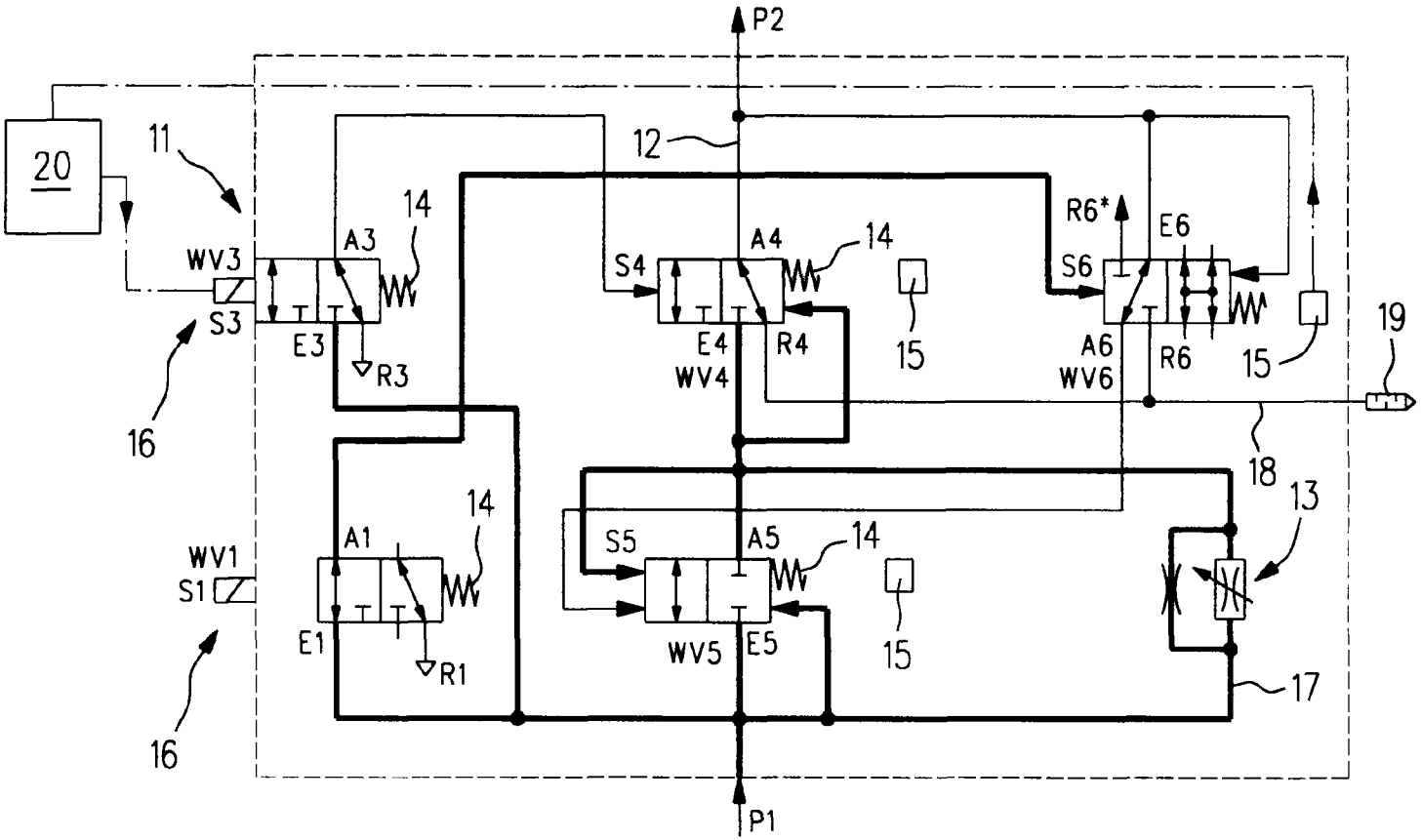
FIG. 2 shows the valve circuit according to FIG. 1 in the diagnostic mode after the first directional valve has been switched.

FIG. 2 shows the test mode, in which initially only the first directional valve WV1 has been switched into its open position, allowing compressed air at primary pressure to reach the control side S6 of the sixth directional valve WV6. In the test or diagnostic mode, a switching state enquiry of this sixth directional valve WV6 is executed by means of the sensor 15 assigned to the sixth directional valve WV6. The sensor 15 detects the switching state of the sixth directional valve WV6 and transmits signals corresponding thereto to a control unit 20. If the sixth directional valve WV6 is in its functional position as shown in FIG. 2, the possibility of a malfunction of the sixth directional valve WV6 can be eliminated. Such a malfunction may occur after long stoppages, for example as a result of the "slip-stick" effect mentioned earlier. If the sixth directional valve WV6 switches, the strand comprising the primary inlet P1, the first directional valve WV1 and the sixth directional valve WV6 is free of faults. The control unit 20 now switches the first directional valve WV1 back into its nc-position. If it is found, however, that the sixth directional valve WV6 has not been switched into its functional position as required, the process is aborted, i.e. a continuation of the process will only be possible after the fault has been rectified.

Figure 3:
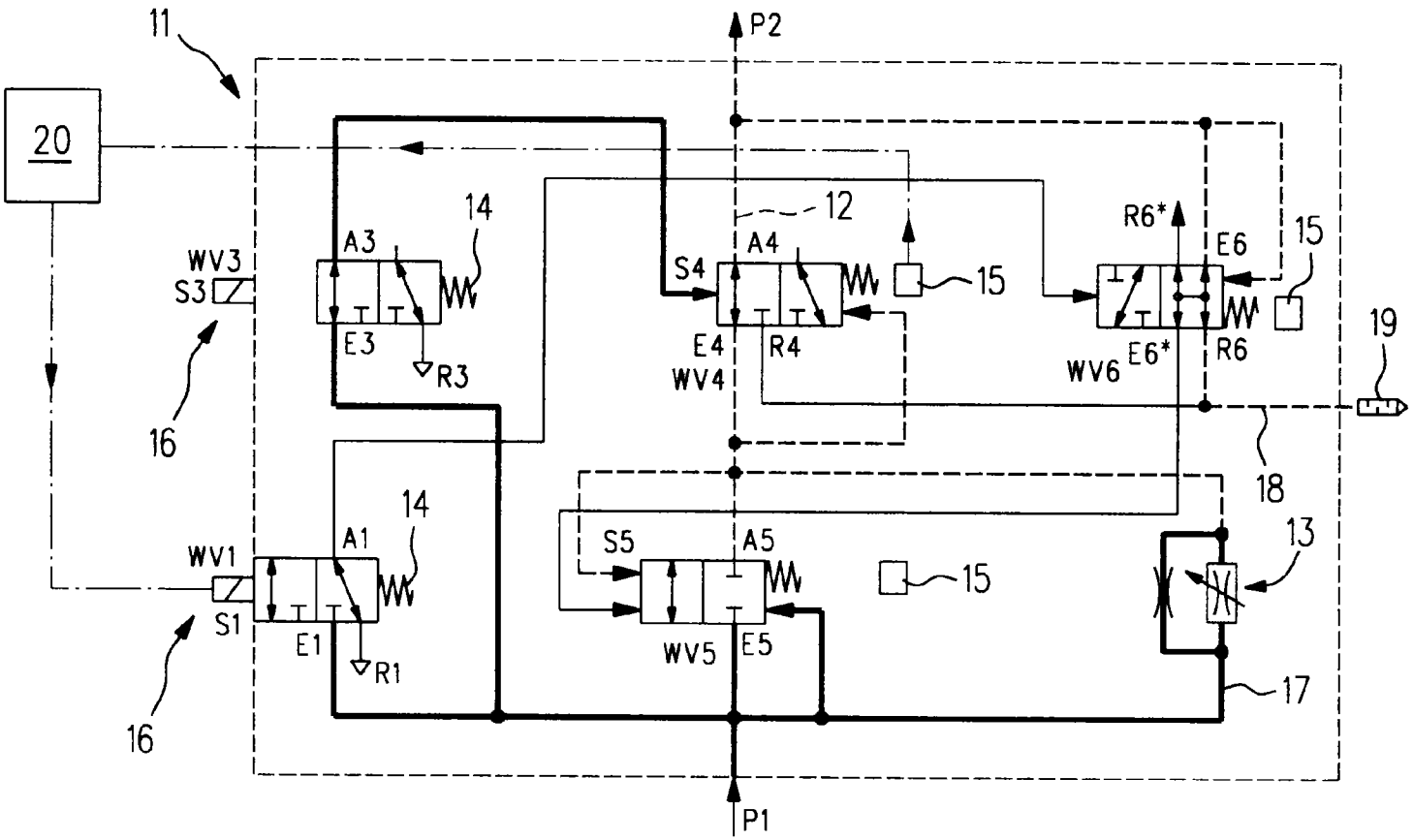
FIG. 3 shows the valve circuit according to FIG. 1 in the diagnostic mode after the third directional valve has been switched, while the first directional valve is in its nc-position.
Figure 4:
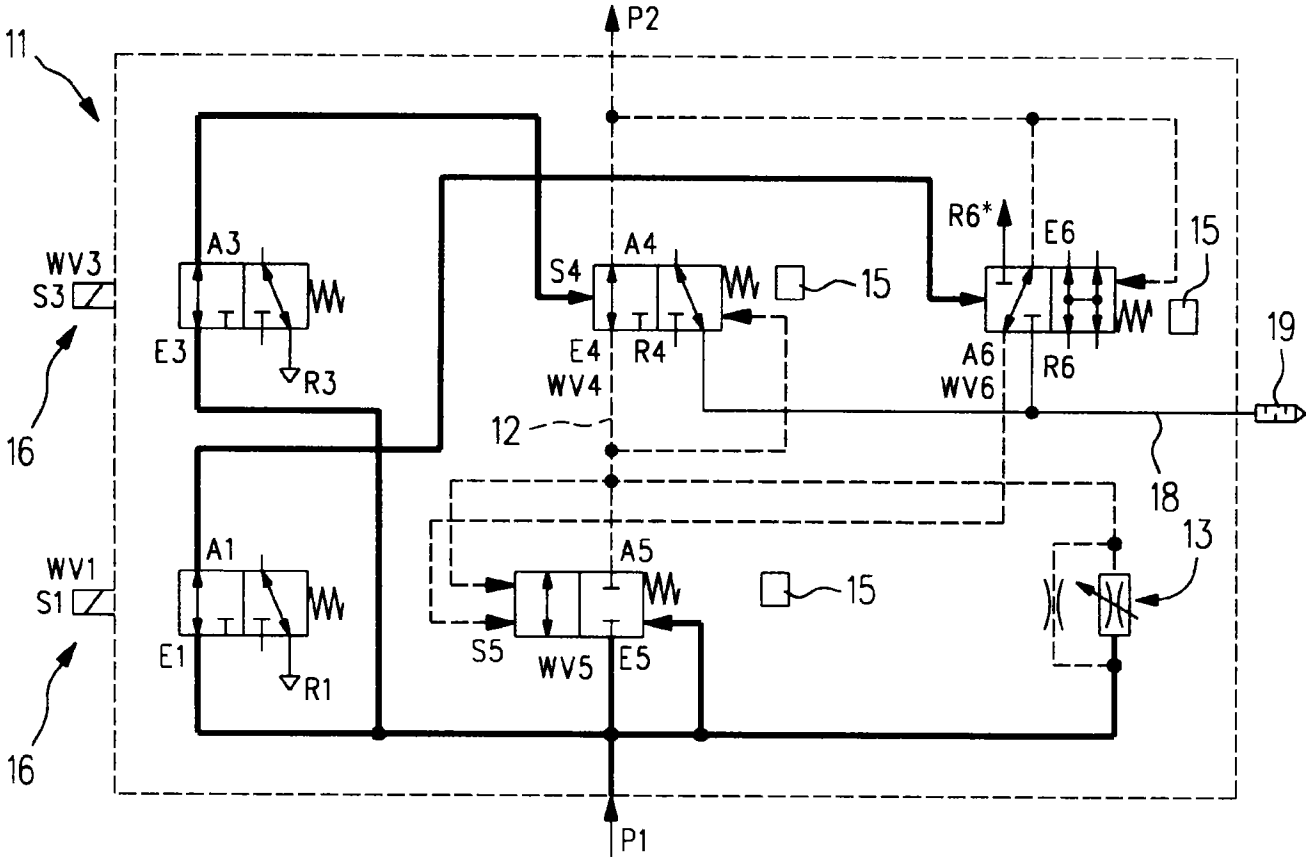
FIG. 4 shows the valve circuit according to FIG. 1 after the first and third directional valves have been switched, the soft start process having been initiated.

FIG. 3 also shows the test mode, in which, after it has been established that the strand comprising the primary the inlet P1, the first directional valve WV1 and the sixth directional valve WV6 is free of faults, the third directional valve WV3 is switched into its open position. The third directional valve WV3 is switched into its open position to allow compressed air at primary pressure to reach the control side S4 of the fourth directional valve WV4. Here, too, a switching state enquiry of the fourth directional valve WV4 is executed by means of the respective sensor 15. The signals corresponding to this switching state are once again transmitted to the control unit 20. If the fourth directional valve WV4 has reached its open position shown in FIG. 3 as required, the strand comprising the primary inlet P1, the third directional valve WV3 and the fourth directional valve WV4 is free of faults. If it is found, however, that the fourth directional valve WV4 has not been switched into its open position as required, the process is once again aborted until the fault has been rectified. If the fourth directional valve WV4 has been switched into its open position as required and the sensor 15 has transmitted corresponding signals about the detected switching state to the control unit 20, the control unit 20 selects the switching means 16 assigned to the first directional valve WV1, thereby automatically initiating the soft start process shown in FIG. 4.

As mentioned above, FIG. 4 shows a switching position at the initiation of the soft start process. The first directional valve WV1 and the third directional valve WV3 have been switched into their open positions as required. Although compressed air at primary pressure has collected in front of the inlet E4 of the fourth directional valve WV4 in its blocked state, this compressed air, which is initially held between the output-side of the restrictor device 13 and the inlet E4 of the fourth directional valve WV4, is discharged as the fourth directional valve WV4 is opened and reaches the primary outlet P2. Compressed air at primary pressure is, however, not able to flow on immediately, because the restrictor device 13 restricts the oncoming compressed air from primary to secondary pressure. As a result, compressed air reaches the fourth directional valve WV4 at secondary pressure and flows from there to the primary outlet P2. At the same time, compressed air at secondary pressure flows to the inlet E6 of the sixth directional valve WV6 and from there via the outlet A6 to the control side S5 of the fifth directional valve WV5. At the same time, there is a direct connection from the output side of the restrictor device 13 to the control side S5 of the fifth dc WV5, so that compressed air at secondary pressure is applied twice to the control side of the fifth directional valve WV5. The pressure at the secondary outlet P2 now increases gradually until, from a defined ratio between secondary and primary pressure, the fifth directional valve WV5 is caused to switch into its open position. This ratio between secondary and primary pressure may lie in the range between >0 and 1, in particular between 0.4 and 0.6. Particularly preferred is a switching into open position if the secondary pressure P2 is approximately equal to 0.5 of the primary pressure P1.

Figure 5:
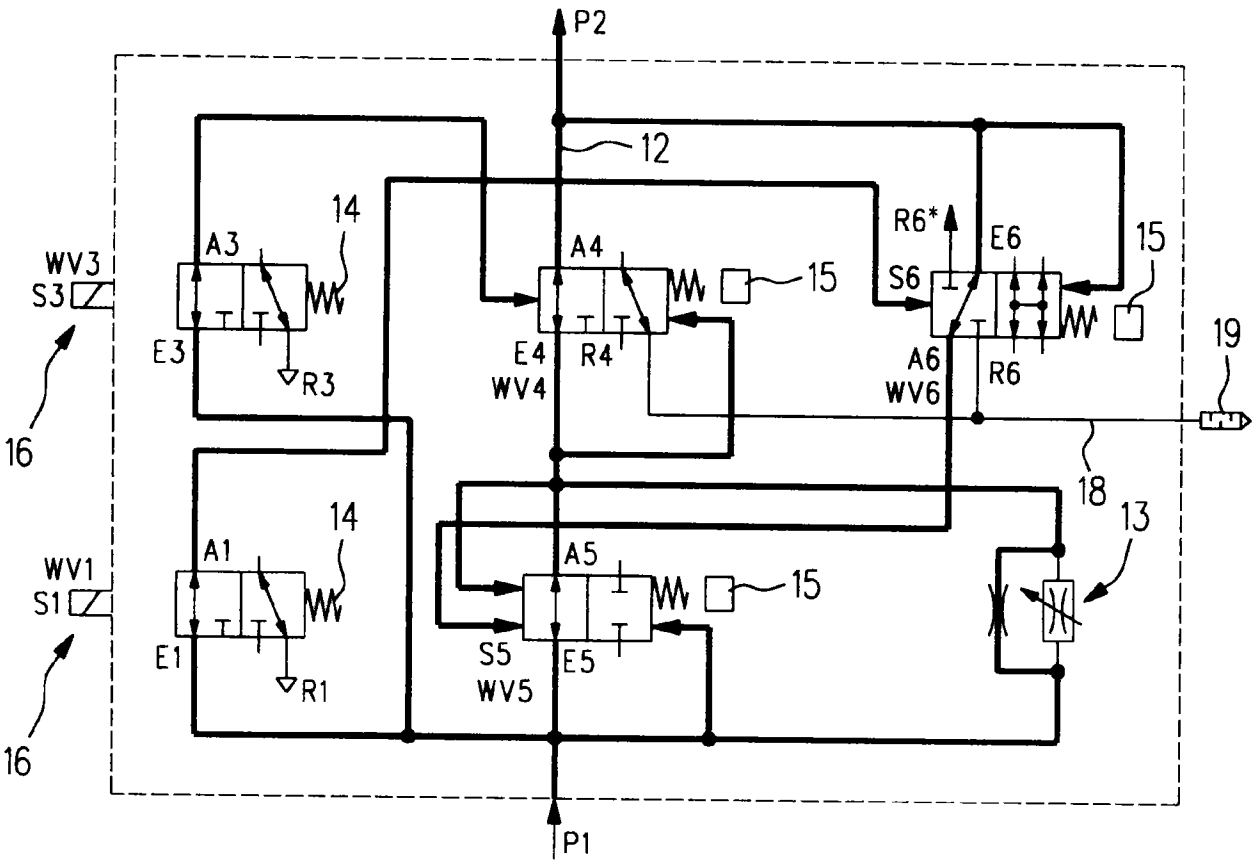
FIG. 5 shows the valve circuit according to FIG. 1 after the soft start process.

FIG. 5 shows the switching position after the soft start process. The fifth directional valve WV5 has been opened by the pressure applied to its control side S5, allowing compressed air to flow directly from the primary inlet P1 via the main flow path 12, passing through the fourth directional valve WV4, to the secondary outlet P2 and from there to the loads.

Figure 6:
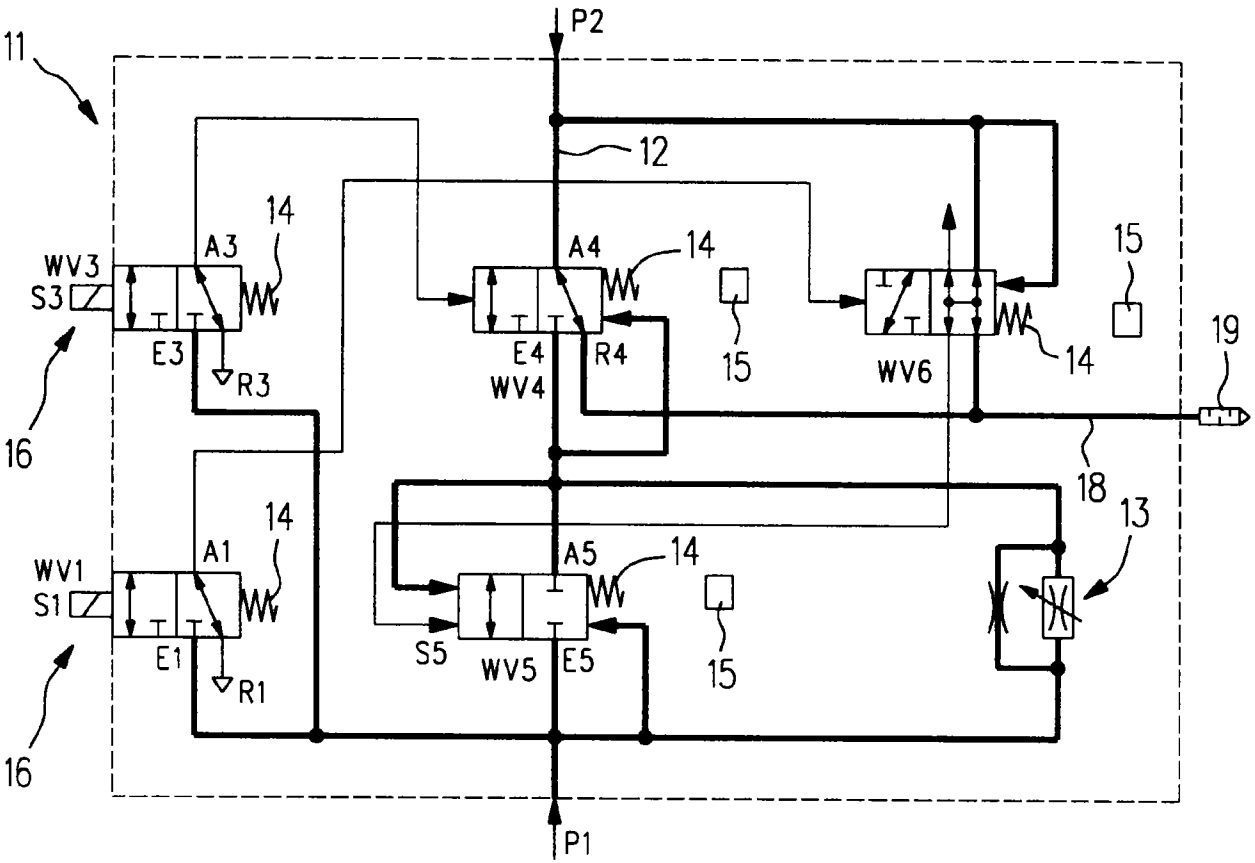
FIG. 6 shows the valve circuit according to FIG. 1 during the venting process in a standard switching position for venting.

FIG. 6 shows a standard switching position for venting the secondary outlet P2. The first and third directional valves WV1 and WV3 have been switched back into their nc-positions as required, so that the compressed air applied to the control side S4 of the fourth directional valve WV4 escapes via the venting port R3, while the compressed air applied to the control side S6 of the sixth directional valve WV6 escapes via the venting port R1. As a result, the fourth directional valve WV4 is returned into an nc-position, while the sixth directional valve WV6 is returned into its normal position. Compressed air from the secondary outlet P2 can now escape via the venting port R4 of the fourth directional valve WV4 and in addition via the venting port R6 of the sixth directional valve WV6. The venting ports R4 and R6 are preferably combined to form a common central venting port 18 open to the atmosphere. The central venting port 18 may be provided with a silencer 19 to attenuate the sound of the escaping compressed air.

If the soft start process is aborted and venting is required, the standard switching position for venting will be established, i.e. compressed air from the secondary outlet P2 escapes via the venting ports R4 and R6 of the fourth and sixth directional valves WV4 and WV6 respectively.

Figure 7:
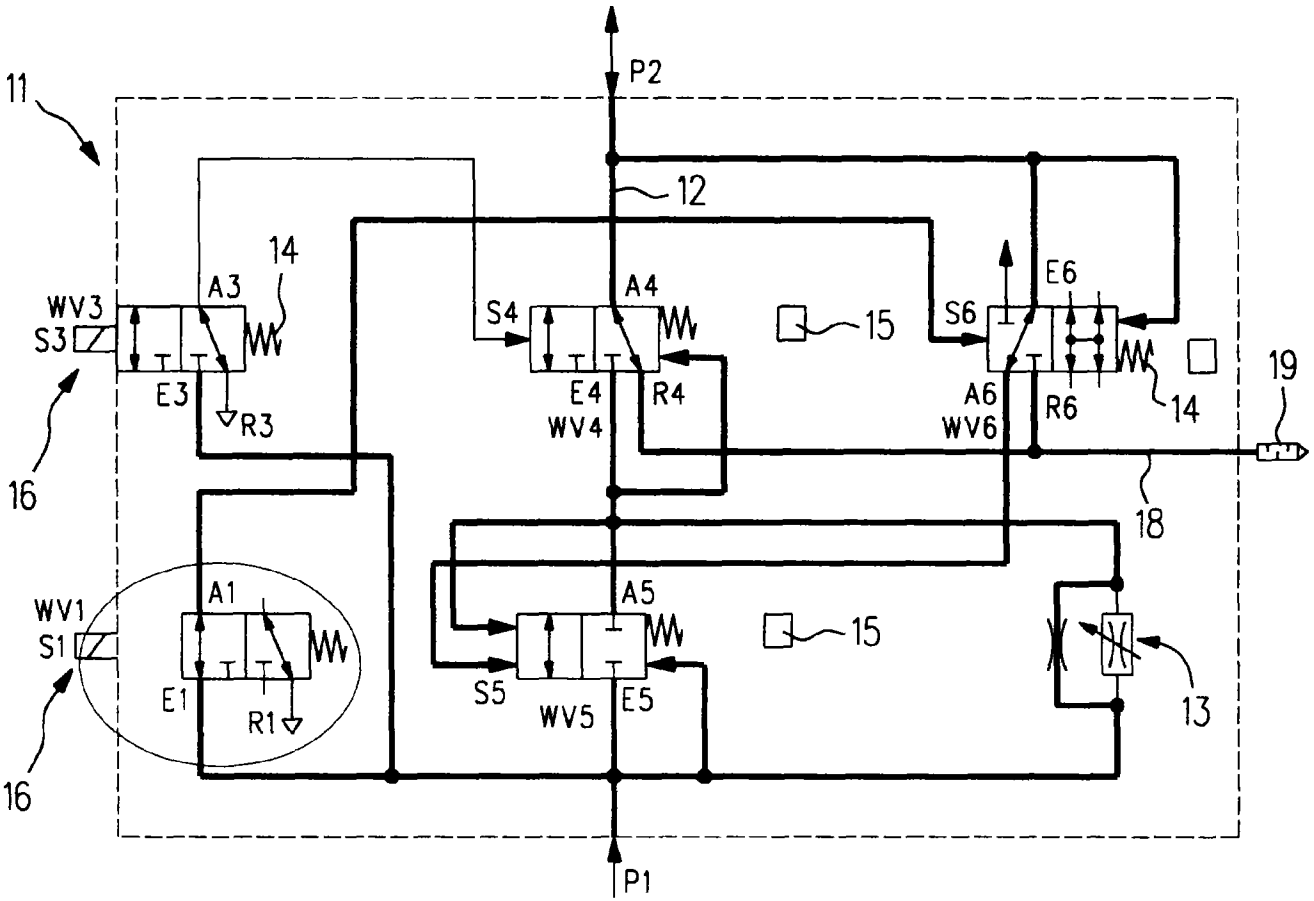
FIG. 7 shows the valve circuit according to FIG. 1 during the venting process, the first directional valve malfunctioning.

FIG. 7 shows a switching position for venting in which the first directional valve WV1 malfunctions, i.e. does not return into its nc-position. This leaves the path E1-A1 open, and compressed air is still applied to the control side S6 of the sixth directional valve WV6, holding it in its functional position. This means that the venting port R6 of the sixth directional valve WV6 is blocked. Venting is nevertheless possible, because the third directional valve WV3 has returned into its nc-position as required, allowing the compressed air applied to the control side S4 of the fourth directional valve WV4 to escape via the venting port R3, which causes the fourth directional valve WV4 to return into its nc-position. Compressed air from the secondary outlet P2 can now escape into the venting port R4. In addition, the control side S5 of the fifth directional valve WV5 is vented via A6-E6 and the venting port R4, so that the fifth directional valve WV5 returns into its nc-position.

Figure 8:
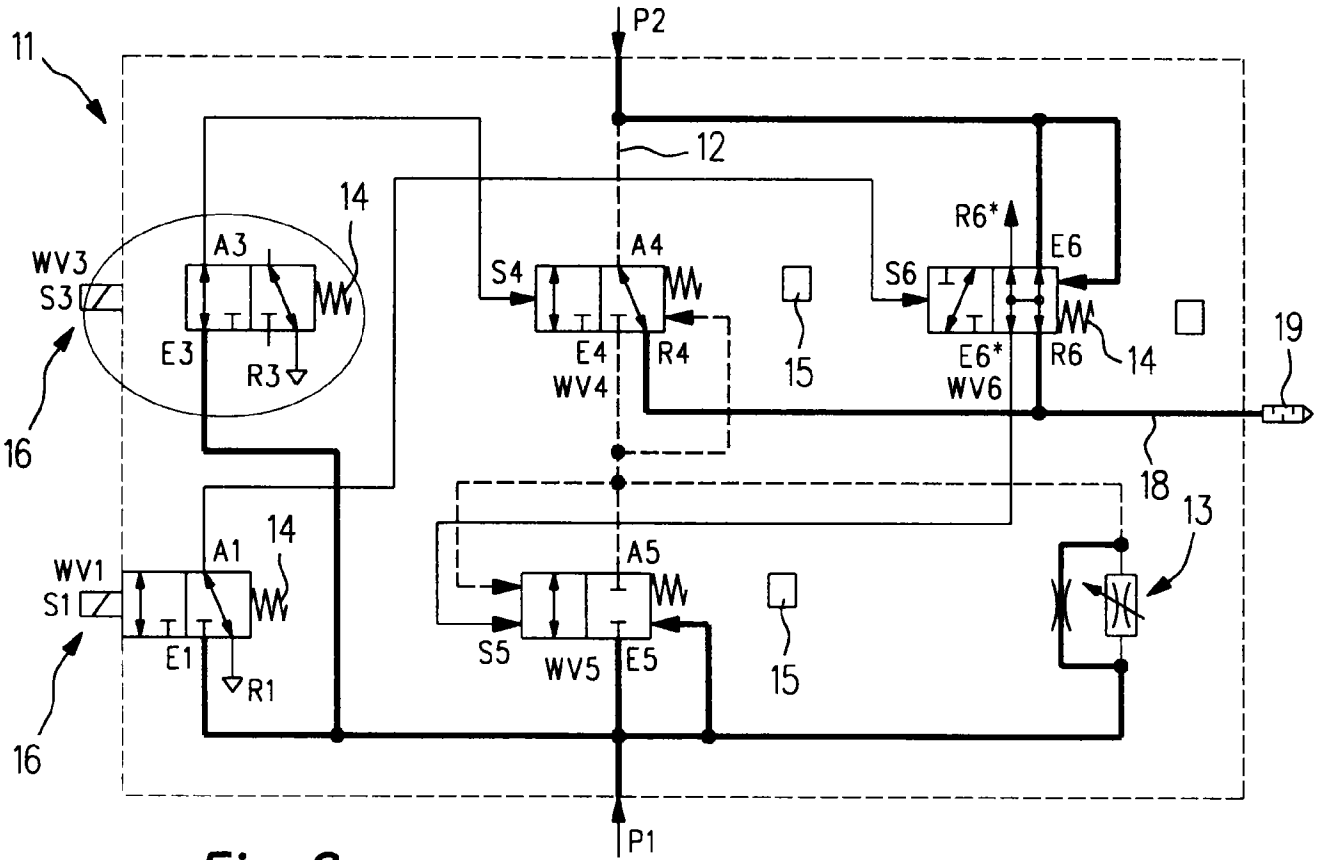
FIG. 8 shows the valve circuit according to FIG. 1 during the venting process, the third directional valve malfunctioning.

FIG. 8 shows a switching position for venting in which the third directional valve WV3 malfunctions, i.e. does not return into its nc-position. This leaves the path E3-A3 open, and compressed air is still applied to the control side S4 of the fourth directional valve WV4, holding it in its open position. This means that the venting port R4 of the fourth directional valve WV4 is blocked. Venting is nevertheless possible, because the first directional valve WV1 has returned into its nc-position as required, allowing the compressed air applied to the control side S6 of the sixth directional valve WV6 to escape via the venting port R1, which causes the sixth directional valve WV6 to return into its normal position. Compressed air from the secondary outlet P2 can now escape via the venting port R6. In addition, the control side S5 of the fifth directional valve WV5 is vented to the atmosphere via A6-E6, so that the fifth directional valve WV5 returns into its nc-position.

Figure 9:
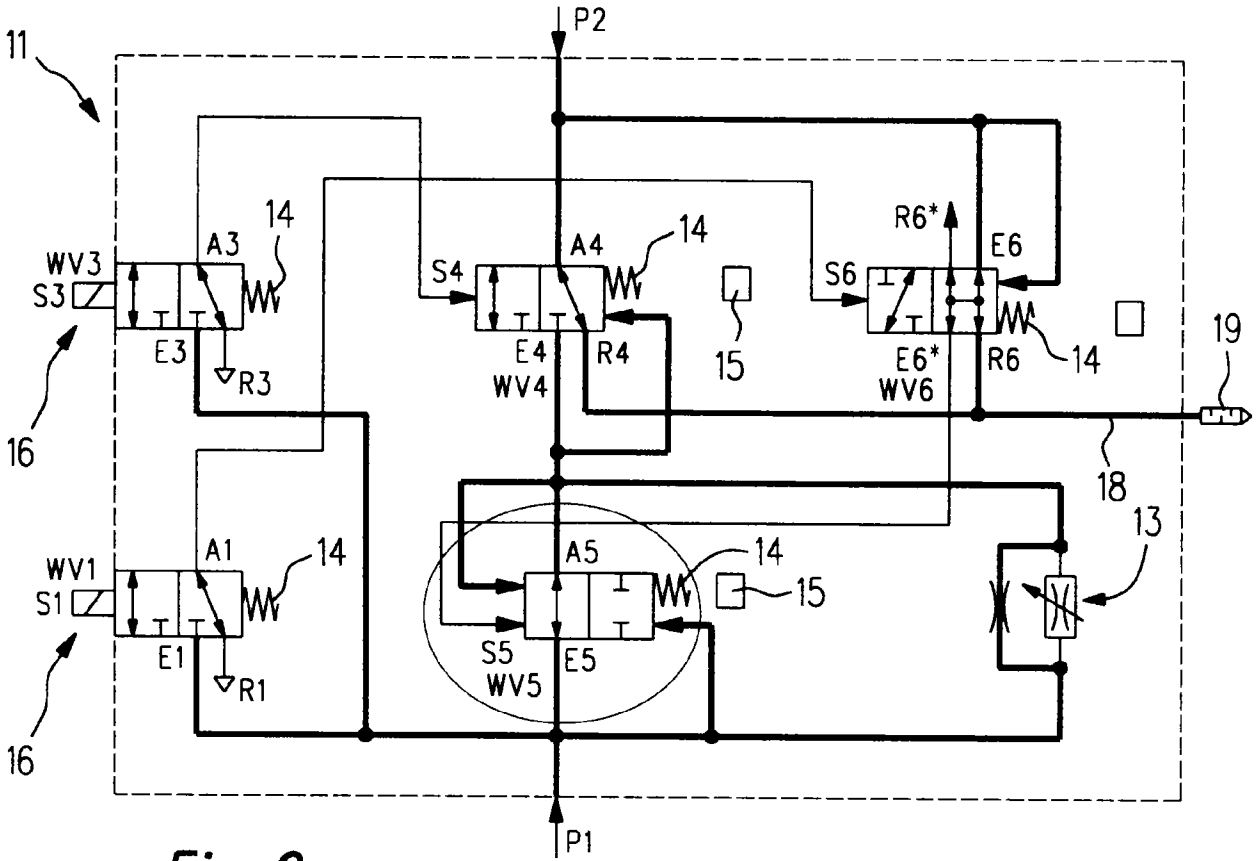
FIG. 9 shows the valve circuit according to FIG. 1 during the venting process, the fifth directional valve malfunctioning.

FIG. 9 shows a switching position for venting in which the fifth directional valve WV5 malfunctions, i.e. does not return into its nc-position. This leaves the main flow path 12 via E5-A5 open, allowing compressed air from the primary inlet P1 to flow. Venting is nevertheless possible, because the two directional valves WV1 and WV3 have returned into their nc-positions, venting both the control side S4 of the fourth directional valve WV4 and the control side S6 of the sixth directional valve WV6, so that the fourth and sixth directional valves WV4 and WV6 have returned into the nc-position or normal position respectively. This once again allows the venting of the compressed air from the secondary outlet P2 via the venting ports R4 and R6.

Figure 10:
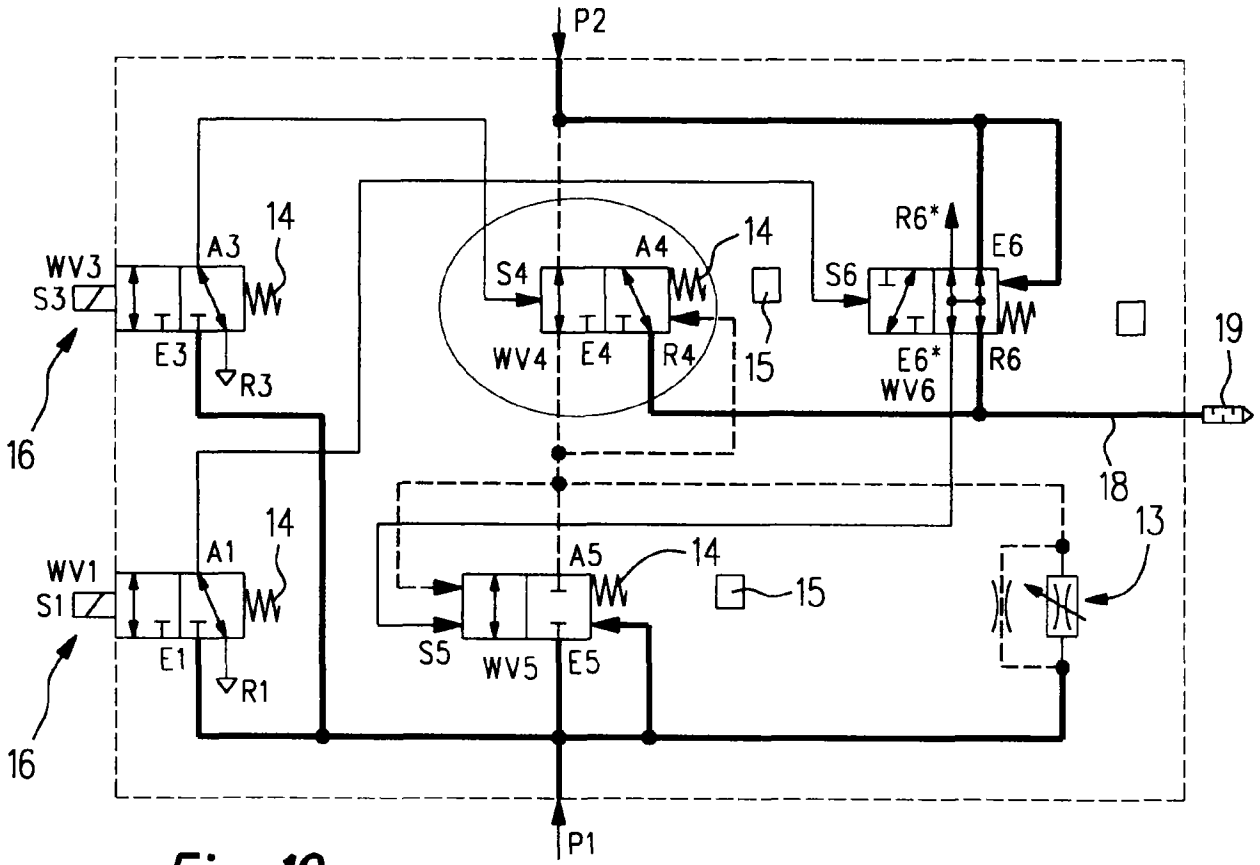
FIG. 10 shows the valve circuit according to FIG. 1 during the venting process, the fourth directional valve malfunctioning.

FIG. 10 shows a switching position for venting in which the fourth directional valve WV4 malfunctions, i.e. does not return into its nc-position. This blocks the venting port R4. Venting is nevertheless possible, because the first and third directional valves WV1 and WV3 have returned into their nc-positions as required, venting in particular the control side S6 of the sixth directional valve WV6, causing it to return into its normal position, so that compressed air applied to the control side S5 of the fifth directional valve WV5 is vented via E6* and R6* and the fifth directional valve WV5 also returns into its nc-position. Compressed air from the secondary outlet P2 can now escape via the venting port R6.

Figure 11:
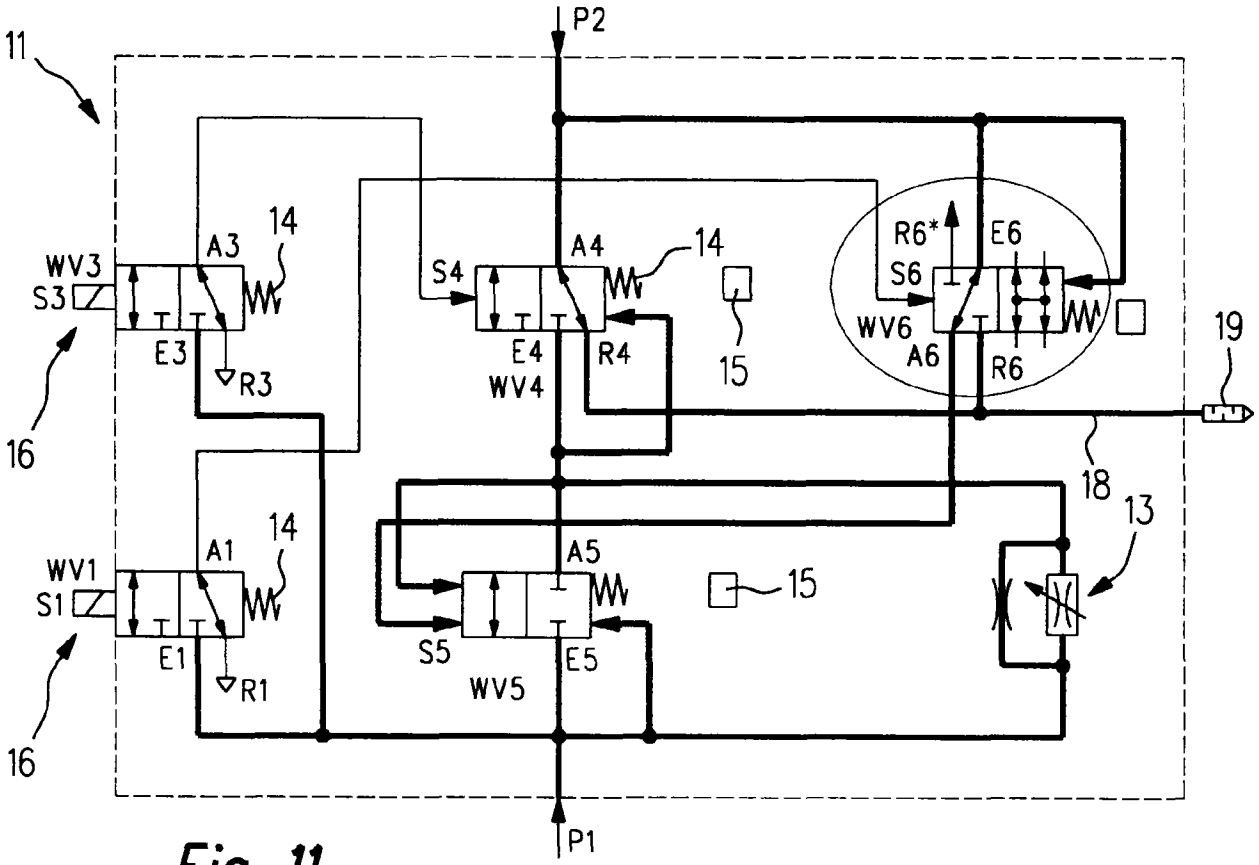
FIG. 11 shows the valve circuit according to FIG. 1 during the venting process, the sixth directional valve malfunctioning.

FIG. 11 finally shows a switching position for venting in which the sixth directional valve WV6 malfunctions, i.e. does not return into its normal position. This blocks the venting port R6. However, the first and third directional valves WV1 and WV3 have returned into their nc-positions as required, so that the control side S4 of the fourth directional valve WV4 is vented, returning this valve into its nc-position, so that compressed air from the secondary outlet P2 can escape via the venting port R4. In addition, the control side R5 is vented via A6-E6 and the venting port R4, causing the fifth directional valve WV5 to return into its nc-position.

The invention claimed is:

1. Soft start device for pneumatic systems, comprising a primary inlet where compressed air can be supplied at a primary pressure, wherein the primary inlet is, via a valve circuit, connected to at least one secondary outlet which can be coupled to a load and where compressed air can be discharged, wherein a main valve of a type 2/2 nc (normally closed) which can be bypassed by means of a bypass is installed between the primary inlet and the secondary outlet, a restrictor device being installed in the bypass, wherein the main valve and the restrictor device together with further directional valves of the valve circuit are interconnected such that, in a start process while the main valve is initially closed, compressed air is applied to the secondary outlet at a secondary pressure which is lower than the primary pressure and increases gradually, until from a defined ratio between the secondary and the primary, pressure the main valve is switched to its open position, so that compressed air arrives at the secondary outlet at the primary pressure, and so that the valve circuit can be placed in a standard switching position for venting, so that the secondary outlet is vented, and wherein an inlet of the main valve, which is designed as a fifth directional valve of the type 2/2-nc, is connected to the primary inlet and an outlet is connected in parallel to both an inlet of a fourth directional valve of a type 3/2-nc and to an output-side of the restrictor device, the fifth directional valve having a control side coupled to the output-side of the restrictor device and in addition to an outlet of a sixth directional valve of a type 4/2-nc, an inlet of a first directional valve of the type 3/2-nc is connected to the primary inlet and an outlet is connected to a control side of a sixth directional valve, wherein the first directional valve can be vented via a venting port and actively switched via a control-side switching means, an inlet of a third directional valve of the type 3/2-nc is connected to the primary inlet and an outlet of the third directional valve is coupled to a control side of a fourth directional valve of the type 3/2-nc, wherein the third directional valve can be vented via a venting port and actively switched via the control-side switching means, an outlet of the fourth directional valve is connected in parallel to both the secondary outlet and to an inlet of the sixth directional valve, wherein the fourth directional valve can be vented via a venting port, and the sixth directional valve can be switched between a normal position and a functional position, wherein in the normal position a first inlet of the sixth directional valve is connected in parallel to both the secondary outlet and to the outlet of the fourth directional valve, while a respective first venting port is open to the atmosphere, and a second inlet is coupled to a control side of the fifth directional valve while a respective second venting port is open to the atmosphere, and wherein, in the functional position, the inlet of the sixth directional valve is connected in parallel to both the outlet of the fourth directional valve and to the secondary outlet, while a respective outlet is coupled to the control side of the fifth directional valve.

2. Soft start device according to claim 1, wherein the venting ports of the fourth and sixth directional valves are combined to form a common central venting port open to the atmosphere.

3. Soft start device according to claim 1, wherein the central venting port is provided with a silencer to attenuate any the sound of the escaping compressed air.

4. Soft start device according to claim 1, wherein the fifth directional valve is held in its nc-position by a control spring and in addition by the application of compressed air, and wherein the fourth directional valve is held in its nc-position by a control spring and in addition by the application of compressed air, and wherein the sixth directional valve is held in its normal position by a control spring and in addition by the application of compressed air.

5. Soft start device according claim 1, wherein the restrictor device comprises an adjustable throttle valve and in addition a fixed restrictor in the form of a restrictor bypass surrounding the adjustable throttle valve.

6. Soft start device according claim 1, wherein a ratio between secondary and primary pressure from which the main valve is switched into its open position lies in the range between 0.4 and 0.6.

7. Soft start device according to claim 1, wherein a sensor device comprising a plurality of sensors is provided for detecting the current switching states of the directional valves.

8. Soft start device according to claim 7, wherein the sensors are designed as reed switches.

9. Soft start device according to claim 1, wherein a control unit coupled to the switching means of the first and third directional valves is provided.

10. Method for the operation of said soft start device according to claim 1, comprising the following steps of the soft start process:

switching of the first directional valve into its open position, whereby compressed air is applied to the control side of the sixth directional valve, determining a switching state of the sixth directional valve by means of the respective sensor, detecting a result of a switching state enquiry wherein, if a switching operation of the sixth directional valve has been detected, a switching operation of the third directional valve or the soft start process is initiated, switching of the third directional valve into its open position after or alternatively before the switching of the first directional valve, wherein the first directional valve is in its nc-position while the third directional valve is switched, wherein compressed air is applied to the control side of the fourth directional valve by switching the third directional valve, determining a switching state of the fourth directional valve by means of the respective sensor, detecting a result of a switching state enquiry wherein, if a switching operation of the fourth directional valve has been detected, a switching operation of the first directional valve or the soft start process is initiated.

11. Method according to claim 10, wherein signals corresponding to the result of the switching state enquiry are transmitted from the respective sensor to the control unit, and wherein the switching means assigned to the first and third directional valves are actuated or not depending on the switching state result.

* * * * *